US005312697A

United States Patent [19]

Kiser et al.

[11] Patent Number: 5,312,697

[45] Date of Patent: May 17, 1994

[54] ALLOY OVERLAY HAVING THERMAL CHARACTERISTICS SIMILAR TO THOSE OF A SUBSTRATE

[75] Inventors: Samuel D. Kiser, Catawba, N.C.; Melissa A. Moore, South Point, Ohio; David B. O'Donnell, Huntington, W. Va.

[73] Assignee: Inco Alloys International, Inc., Huntington, W. Va.

[21] Appl. No.: 874,232

[22] Filed: Apr. 24, 1992

[51] Int. Cl.[5] ..... B32B 15/18; C22C 19/05

[52] U.S. Cl. ..... 428/679; 420/442; 420/453

[58] Field of Search ..... 428/679; 420/442, 453

[56] References Cited

U.S. PATENT DOCUMENTS

| | | | |
|---|---|---|---|
| 2,392,821 | 1/1946 | Kreag | 78/103 |
| 2,783,144 | 2/1957 | Payson et al. | 75/171 |
| 2,921,850 | 1/1960 | Inouye et al. | 420/442 |
| 3,804,680 | 4/1974 | Martin et al. | 420/451 |
| 3,839,024 | 10/1974 | Demo et al. | 420/442 |
| 4,228,223 | 10/1980 | Knotek et al. | 428/558 |
| 4,331,741 | 5/1982 | Wilson | 428/679 |
| 4,430,297 | 2/1984 | Crook | 420/442 |
| 4,585,620 | 4/1986 | Kamohara et al. | 420/453 |
| 4,818,486 | 4/1989 | Rothman et al. | 420/442 |

FOREIGN PATENT DOCUMENTS

| | | | |
|---|---|---|---|
| 277170 | 9/1927 | United Kingdom | 420/442 |
| 791229 | 2/1958 | United Kingdom | 420/453 |
| 791537 | 3/1958 | United Kingdom | 420/442 |
| 869753 | 6/1961 | United Kingdom | 420/453 |

OTHER PUBLICATIONS

F. S. Badger, "New Alloy N Joins Hastelloy Family", Chemical Engineering, May 4, 1959, pp. 162, 164, 166.

Alloy digest "Hastelloy ® Alloy-N" (Feb. 1960) Engineering Alloys Diges, Inc., Upper Montclair, N.J.

Alloy Digest "Inconel ®Alloy 625" (Feb. 1967) Engineering Alloys Digest, Inc., Upper Montclair, N.J.

*Primary Examiner*—John Zimmerman

*Attorney, Agent, or Firm*—Edward A. Steen

[57] ABSTRACT

A nickel-base alloy suitable for overlaying steel substrates. The alloy and steel have similar thermal conductivities and thermal coefficients of expansion. The alloy broadly initially contains about 15-20% molybdenum, about 5-10% chromium, up to about 2% iron, up to about 5% tungsten and/or niobium, up to about 0.1% carbon, and the balance essentially nickel.

4 Claims, No Drawings

ALLOY OVERLAY HAVING THERMAL CHARACTERISTICS SIMILAR TO THOSE OF A SUBSTRATE

TECHNICAL FIELD

The instant invention relates to overlaying material in general and, more particularly, to a nickel-base overlay having targeted high thermal conductivity (TC) and low coefficient of thermal expansion (COE) characteristics.

BACKGROUND ART

There are numerous industrial situations where it is desirable to have a nickel-base overlay deposed over a steel substrate. In particular, overlay applications include continuous casting rolls in steel mills, basic oxygen process ("BOP") furnace hood tubing, and centrifugal casting molds for tubing.

Other typical non-limiting applications involve low alloy steels that suffer repeated, severe temperature cycles causing them to fail by thermal fatigue cracking. For instance, it is desirable to overlay hot forging dies and extrusion dies where deformation by the work being done is not the overwhelming cause of failure.

Efforts have been undertaken wherein 606 and 625 alloys are used as overlays. However, it is desirable to have an overlay that is rich in nickel and lower in chromium so that the COE and TC are approximately equal to those of the underlay mild steel substrate after iron dilution has occurred.

Accordingly, there is a need for an overlay composition that closely matches the COE and TC of a steel substrate while simultaneously providing adequate protection.

SUMMARY OF THE INVENTION

Accordingly, there is provided an alloy cladding composition suitable for mild steel overlaying. The non-age hardenable, thermal fatigue resistant alloy exhibits a COE substantially equivalent to the steel and a TC approximately equal to or greater than the steel substrate.

PREFERRED EMBODIMENT OF THE INVENTION

The instant alloy generally includes about 15–20% molybdenum, about 5–10% chromium, up to about 2% iron, less than about 0.1% carbon, commercially acceptable low levels of impurities, and the remainder nickel with an optional 0–5% range of tungsten and/or niobium. The low coefficient of thermal expansion is approximately 6.5–7.2 in/in/° F.$\times 10^{-6}$ at 800° F. (1.1–1.3$\times 10^{-5}$ mm/mm/° C. at 426° C.) and the high thermal conductivity is equal to about 100–130 BTU-in/ft$^2$-h-° F. at 800° F. (14.4–18.7 w/m-K at 700° K.).

The instant alloy is preferably deposited on mild and low alloy steels (such as UNS G86200) having similar COE and TC values.

A more preferred alloy target includes about 19% molybdenum, about 6% chromium, about 1% iron, and the balance nickel. Up to about 4% tungsten and/or niobium may be considered for weldability if necessary.

The composition will be most useful in situations where a mild steel substrate may be economically employed but must be protected from thermal, physical or chemical attack. This combination or binary structure reduces the need for more expensive materials.

For example, assume that water cooling on the back side of the steel substrate is required (as in a die) and heat is applied to the overlay side. In this situation, thermal conductivity through the overlaid steel composite is critical to efficient use of the water cooling. For example, if the thermal conductivity of the overlay is lower than that of the steel, the thermal gradient between the steel and the overlay surface will be greater, thus contributing to greater expansion of the overlay than the substrate. The relationship between linear expansion and temperature is well known as &=@ΔT where &=linear expansion, @=coefficient of thermal expansion, and ΔT=temperature difference. By controlling @ to approximate @ of the steel by selecting chemistry, and by minimizing ΔT by maximizing thermal conductivity, the difference between the & of the overlay and the & of the steel will have been minimized. By maintaining good weldability, good toughness, and sufficient oxidation resistance, while selecting the chemistry to yield the most compatible @ and thermal conductivity, an optimum solution has been created.

In view of the environments the binary structure will be exposed to, the nickel-base alloy should not age harden. A typical concern in higher molybdenum content alloys is $\mu$ (mu) phase that imparts brittle behavior in the materials. By controlling the molybdenum content the troublesome $\mu$ phase is absent.

In a similar vein, the alloy is a non $\gamma'$ (gamma prime) strengthened alloy. Super high strengths are not required; $\gamma'$ raises the cost of the alloy unnecessarily; and the precipitation of and solution of $\gamma'$ would contract and expand the alloy matrix unnecessarily. This action would increase the likelihood of thermal cracking, a major source of failure in overlay material.

As a precaution, it is preferred to employ no more than about 10% chromium. For less than 10% chromium, increasing the iron level yields higher, but possibly erroneous, elevated TC calculations. Accordingly, it is preferred to maintain the iron/chromium ratio of the consumable as low s possible (i.e. below about 0.6). It appears that the effect of molybdenum and chromium on TC is not as pronounced as the iron and chromium interaction.

The instant alloy may be applied to the substrate by weld overlay techniques or by composite centrifugal casting. Regarding the latter, many steel mill work rolls are produced by centrifugally casting one alloy first to form the working surface and then casting a second alloy into the spinning mold. A continuous casting roll could be made by first casting the instant alloy to form the work surface followed by the second alloy (steel) into the spinning mold.

The binary structure is made by employing the nickel base alloy as a bare wire electrode in gas metal arc and submerged arc welding applications or in the form of sheet metal strip for submerged arc welding or electroslag welding. During welding, up to about 10% iron dilution from the steel may be expected in the overlay. The remaining alloy constituents will stay essentially fixed.

A preferred target range includes 19–20% molybdenum, 5–6% chromium, about 1% iron, acceptable impurities, and the balance nickel. Tungsten and/or niobium up to about 3% may be optionally present.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

The embodiments of the invention in which an exclusive property or privilege is claimed are defined as follows:

1. A binary structure comprising a mild or low alloy steel substrate and a nickel-base alloy disposed thereon, the alloy having a coefficient of thermal expansion of about $7.2\times10^{-6}$ in/in/° F. at 800° F. and a thermal conductivity of about 100–130 BTU-in/ft$^2$hr-° F. at 800° F. which is physically and thermally compatible with the steel substrate and including 19–20% molybdenum, 5–6% chromium, up to about 2% iron, the iron/-chromium ratio less than about 0.6, up to about 3% tungsten and/or niobium, up to about 0.1% carbon, commercially acceptable levels of impurities, and the balance nickel.

2. The binary structure according to claim 1 wherein the alloy includes 19% molybdenum, 6% chromium, about 1% iron, up to about 3% tungsten, up to about 0.06% carbon, and about 68% nickel.

3. The binary structure according to claim 1 where the alloy is welded to the substrate.

4. The binary structure according to claim 3 wherein the alloy is centrifugally cast upon the substrate.

* * * * *